United States Patent [19]

Don Carlos

[11] 4,218,009

[45] Aug. 19, 1980

[54] FIBREBOARD BOX CLOSURE

[75] Inventor: Alva G. Don Carlos, Tonganoxie, Kans.

[73] Assignee: Hallmark Cards, Incorporated, Kansas City, Mo.

[21] Appl. No.: 38,383

[22] Filed: May 14, 1979

[51] Int. Cl.[2] ..... B65D 5/08; B65D 5/10

[52] U.S. Cl. ..... 229/39 R; 229/41 B

[58] Field of Search ..... 229/39 R, 41 R, 41 B

[56] References Cited

U.S. PATENT DOCUMENTS

| | | | |
|---|---|---|---|
| 2,361,603 | 10/1944 | Cohen et al. | 229/39 R |
| 2,861,734 | 11/1958 | Garman | 229/41 B |
| 3,539,090 | 11/1970 | Blasdell | 229/39 R |
| 3,655,116 | 4/1972 | Tanner | 229/39 R |
| 3,960,313 | 6/1976 | Sax et al. | 229/41 B |
| 4,007,869 | 2/1977 | Stolkin et al. | 229/39 R X |
| 4,094,459 | 6/1978 | Coons | 229/41 B |
| 4,142,666 | 3/1979 | Rosenbaum | 229/39 R |

*Primary Examiner*—Davis T. Moorhead

*Attorney, Agent, or Firm*—Schmidt, Johnson, Hovey & Williams

[57] ABSTRACT

An improved storage and/or shipping box is provided having specially designed top closure flaps allowing easy mechanical interlocking of the flaps without tearing or other structural damage thereto, while at the same time permitting the flaps to be folded together and taped shut to close and seal the box in the conventional fashion for shipping purposes. A pair of adjacent rectangular closure flaps are provided with respective cut and weakness lines so as to present shiftable flap elements thereon which can be easily manipulated to allow complete interlocking of the flaps for temporary closure purposes; when it is desired to use the box for shipping purposes, the rectangular flaps can be folded together in the normal fashion, and the box taped shut.

9 Claims, 7 Drawing Figures

Fig. 1.
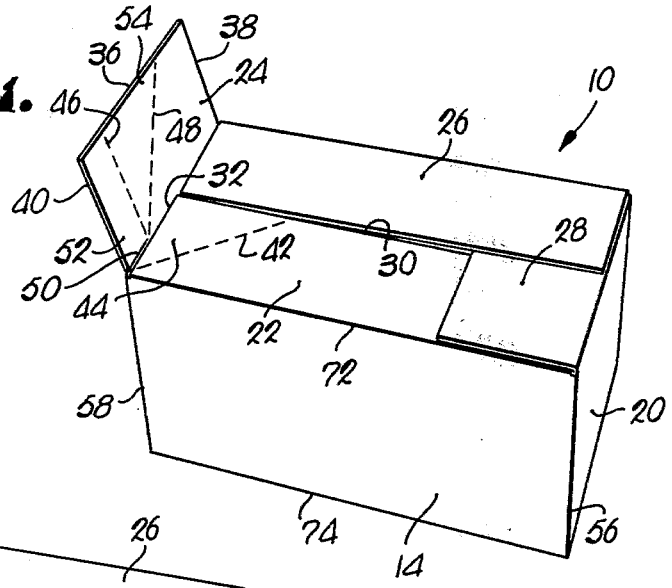
Fig. 2.
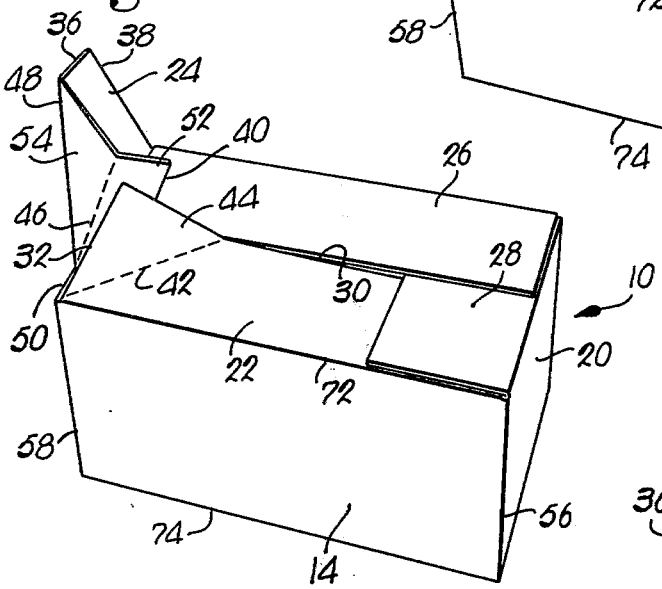
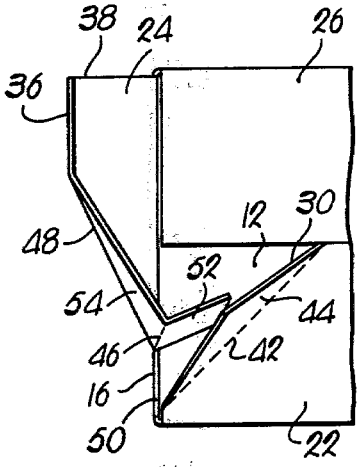
Fig. 3.
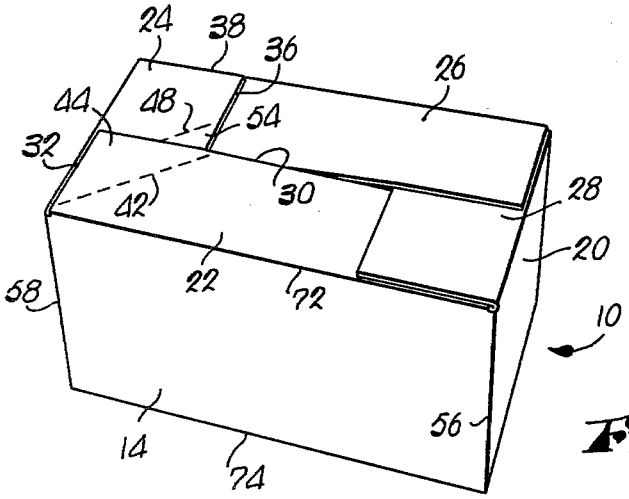
Fig. 4.

FIBREBOARD BOX CLOSURE

BACKGROUND OF THE INVENTION

1. Field of the Invention

The present invention is concerned with a box having interlockable closure flaps, as well as a corresponding box blank. More particularly, the invention is concerned with an improved box or blank construction wherein adjacent top closure flaps are specially configured with cut lines and lines of weakness to greatly facilitate manual interlocking of the flaps such as to permit the box to be used for temporary storage purposes, notwithstanding the fact that the box can be taped shut and sealed for use as a shipping container.

2. Description of the Prior Art

In certain industries it is common practice to have various types or styles of articles produced by independent contractors and/or at various manufacturing locations, whereupon the manufactured materials are sent to a central warehouse and distribution facility. In such cases it is customary to box the manufactured materials (e.g., greeting cards or the like) in warehouse boxes which are advantageously temporarily closed. At the warehouse facility, orders for specific items for the merchandise can be filled and boxed for shipment to retail outlets.

One conventional procedure employed in the past has been to use standard rectangular boxes of conventional design for both warehouse and shipping purposes. However, in order to temporarily close such boxes for warehouse storage, it has been necessary either to tie the boxes with twine using mechanical knotters or the like, or to interlock the top closure panels of the boxes. The first alternative is objectionable for two principal reasons. First, the expense involved in the purchase and upkeep of tying and knotting equipment is considerable, not to mention the manual labor attendant thereto. Furthermore, the string or twine used in such procedures is a continual problem, not only from the standpoint of cleanup, but also because such string, when cut, tends to foul conveying and handling equipment used in the warehouse. The second alternative mentioned avoids some of the above problems, but it is for the most part unacceptable because of the fact that manual interlocking of conventional box flaps tends to structurally damage or tear the boxes, thus making them unusable for final shipping purposes.

It has also been known to provide separate warehouse and shipping cartons which are not used interchangeably. The prime difficulty with this alternative is one of cost, i.e., heavy-duty reusable warehouse boxes must not only be purchased and maintained, but must also be sent back empty to the manufacturing plants for reuse.

Accordingly, there is a need in the art for a box construction which can be effectively used for both warehouse storage and shipping purposes, while avoiding the problems associated with tying or box damage from manual interlocking of the box flaps.

SUMMARY OF THE INVENTION

The present invention solves the problems mentioned above by provision of a box, and a corresponding blank, which includes specially configured flaps allowing the latter to be interlocked without tearing or other damage to the flaps or side panels of the box. Broadly speaking, the box (or blank) of the invention is provided with a pair of adjacent top closure flaps that include respective cut lines and lines of weakness which in effect define flap elements which can be manually manipulated for interlocking purposes.

More specifically, one of the adjacent flaps has a first line of weakness thereon which is preferably angularly disposed and defines, along with the outer margins of the flap, a triangular portion which can be rotated about an axis coincident with the line of weakness. The adjacent flap is provided with second and third weakness lines which preferably define a rectangular segment adjacent the first flap, and a triangular part in juxtaposition to the rectangular segment.

In use, three of four top closure flaps are initially interleaved in the conventional fashion, whereupon the especially configured adjacent flaps can be interleaved, through the use of the described portion, segment and part, in order to completely interlock the box flaps.

BRIEF DESCRIPTION OF THE DRAWINGS

FIG. 1 is a perspective view of a box in accordance with the invention, shown with three of four top closure flaps interleafed, and prior to final interlocking of the specially configured closure flaps;

FIG. 2 is a view similar to that of FIG. 1 but illustrates the first step in the final interlocking process;

FIG. 3 is a fragmentary top view similar to that of FIG. 2 which further illustrates the first step of the final interlocking process;

FIG. 4 is a view similar to that of FIGS. 1–2, and depicts the top closure flaps in a completely interlocked orientation;

DESCRIPTION OF THE PREFERRED EMBODIMENT

Figure 5:
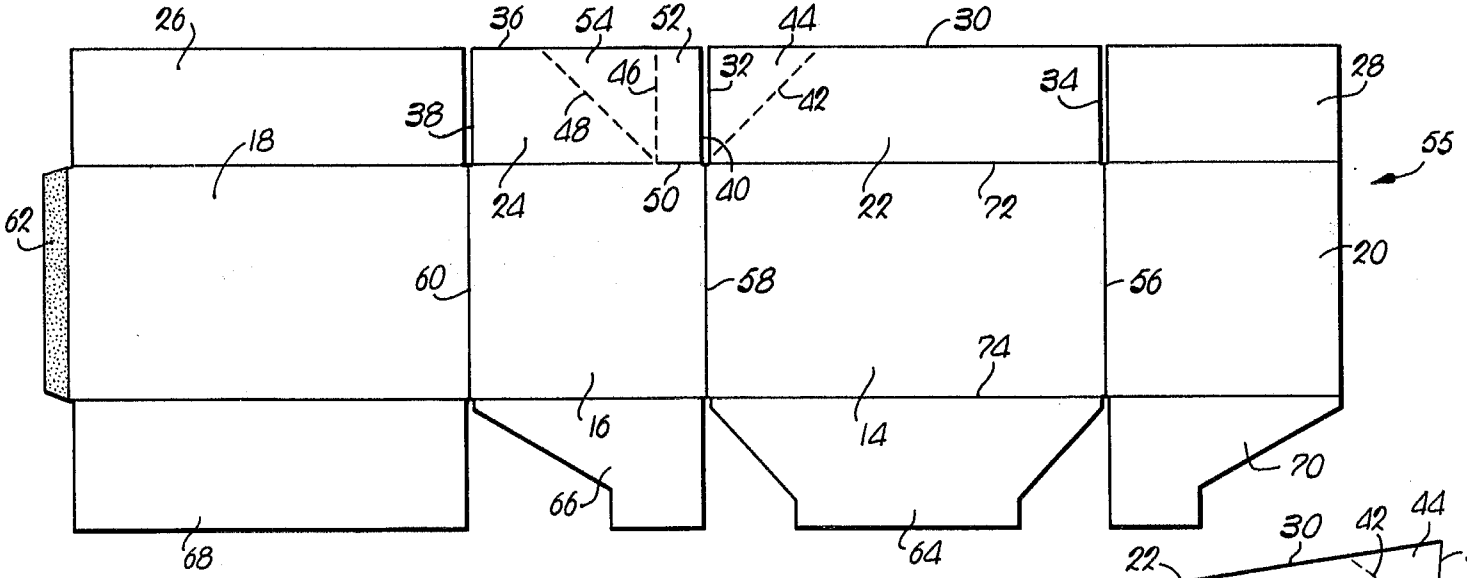
FIG. 5 is a plan view of the blank for making the box illustrated in the preceding Figures.
Figure 6:
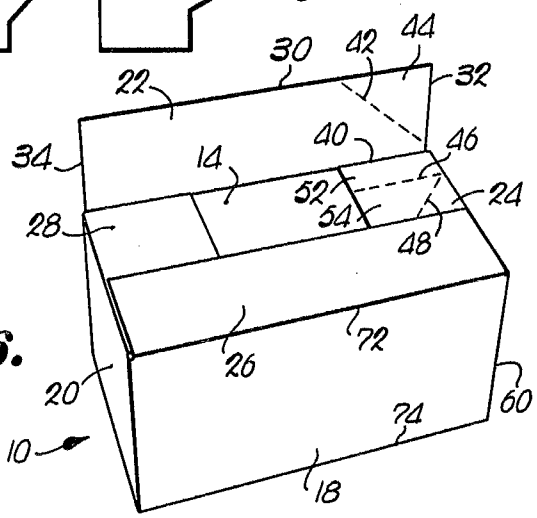
FIG. 6 is a perspective view of the box in accordance with the invention, showing use thereof as a conventional shipping container.
Figure 7:
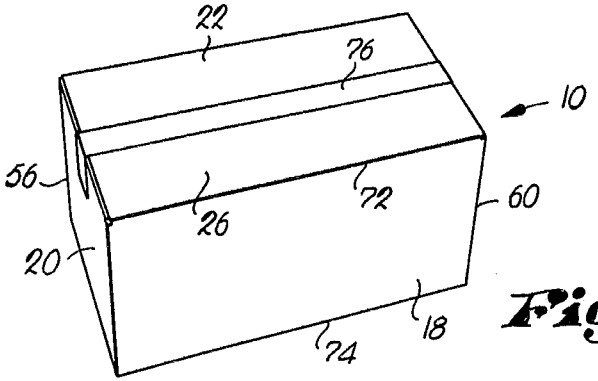
FIG. 7 is a perspective view of the box in accordance with the invention, shown taped and ready for shipping.

Turning now to the drawings, a completed box 10 in accordance with the invention includes a bottom wall 12 of rectangular configuration which is cooperatively defined by a series of bottom closure flaps later to be described. The four-sided bottom wall is connected to first, second, third and fourth sidewall-defining panels 14, 16, 18 and 20. The panels 14–20 are respectively secured to the side edges of bottom wall 12, extend upwardly therefrom, and are interconnected to one another to present a material-holding cavity.

Corresponding first, second, third and fourth top closure flaps 22, 24, 26 and 28 are respectively secured to the upper margins of the corresponding sidewalls 14–20. Each of the closure flaps 22–28 is of rectangular configuration and presents an outermost side edge and spaced, opposed, transversely extending end edges, as can be readily seen from the drawings. For purposes of the present discussion, the outermost side edge of flap 22 will be referred to by the numeral 30, whereas the end edges will be referred to by the numerals 32, 34. In like manner, the outermost side edge of the flap 24 will be referred to by the numeral 36, and the side edges thereof will be referenced with the numerals 38, 40.

Closure flap 22 is provided with a first line of weakness preferably in the form of a perforation line 42 which is adjacent edge 32 and extends from side edge 30 towards panel 14. In particular, the line 42 extends angularly towards panel 14 and flap 24, and intersects the point of intersection between end edge 32 and panel 14. Hence, a triangular flap portion 44 is defined between line 42, edge 32, and a portion of side edge 30.

Closure flap 24 is provided with second and third lines of weakness in the form of perforation lines 46 and 48, both of which extend from respective points on side edge 36 towards panel 16. As illustrated, line 46 is substantially parallel and spaced from end edge 40; moreover, a cut line 50 is provided between line 46 and edge 40 which extends along the length of the juncture between flap 24 and panel 16. Hence, line 46, cut line 50, edge 40, and the endmost section of edge 36 define a rectangular flap segment 52.

Perforation line 48 extends angularly towards panel 16 and closure flap 22. In addition, this line substantially intersects the point of intersection between the line 46 and the panel 16. Thus, a triangular flap part 54 is cooperatively defined by the line 48, line 46, and a section of side edge 36.

As those skilled in the art will readily understand, box 10 is constructed from a specially cut and configured unitary blank formed of a desired material such as fibreboard. Referring to FIG. 5, such a blank 55 is illustrated, and the reference numbers heretofore used in conjunction with the description of the completed box 10 have been applied to this Figure for ease of understanding. However, FIG. 5 better illustrates that the panels 14–20 are connected in order along mutually parallel fold lines 56, 58, and 60. The outermost edge of panel 18 is also provided with a short, trapezoidally configured glue-receiving tab 62 which, in the construction of box 10, is applied to the edge of the panel 20 in order to create a complete enclosure. Similarly, each of the panels 14–20 are provided with conventional bottom closure flaps 64, 66, 68, and 70. Finally, it will be seen that the bottom and top closure flaps connected to each panel (i.e., flaps 22, 64 for panel 14; flaps 24, 66 for panel 16; flaps 26, 68 for panel 18; and flaps 28, 70 for panel 20) are secured along continuous, parallel fold lines 72, 74 which extend the entire length of the blank 55.

During the construction of box 10 from the blank 55, the bottom closure flaps 64–70 are interfolded and secured together by conventional means in order to cooperatively define the rectangular bottom wall 12 for the box; also, the panels 18, 20 are glued together through the tab 62 to present an open-top box.

After box 10 has been initially constructed for use thereof as described, it can be filled with a desired material. In the event that the user elects to temporarily store a given material in the box 10, the closure flaps 14–20 can be easily interlocked without damage to the flaps. This operation is illustrated in FIGS. 1–4. The first step (FIG. 1) involves interleaving the flaps 22, 26 and 28 in the well known fashion, wherein flap 22 extends transversely of the panels 14–20, and flap 24 is free. At this point (FIG. 2) flap portion 44 is rotated back towards panel 14 about an axis coincident with the perforation line 42, so as to present a clearance area beneath the portion 44. Triangular flap part 54 is then folded inwardly against the inner face of flap 24 along an axis coincident with perforation line 48, while segment 52 is folded along an axis coincident with perforation line 46 towards the part 54 and inner face of flap 24 in a manner to clear the folded back portion 44. The shifting is facilitated because of cut line 50, which allows the segment 52 to freely pivot. Segment 52 is then rotated in an opposite direction and is in effect placed under the portion 44. The remainder of the flap 24 can then be pushed fully beneath flap 22 which involves pressing the part 54 and flap 24 downwardly so that the latter assumes an essentially horizontal orientation. The final step involves simply shifting the portion 44 back to its original horizontal position, but now in covering relationship to the adjacent section of the flap 24. In this final disposition (FIG. 4), the closure flaps 22–28 are fully interlocked in the well known manner.

The stability of the interlocked connection of the closure flaps 22–28 is enhanced when the box 10 is essentially full, inasmuch as the contents of the box press against the undersides of the flaps and place the interlocked flaps in tension.

Opening of box 10 from the FIG. 4 interlocked orientation involves simply a reversal of the closing procedure, and thus need not be described in detail.

In the event that it is desired to use box 10 as a conventional shipping container, it is only necessary to fold shorter flaps 24, 28 inwardly, whereupon the longer flaps 22, 26 can be folded over to form a slotted top. At this point a strip of packing tape 76 or similar material can be applied over the slot between the outermost side edges of the flaps 22, 26, in order to seal the box. In this connection it will be understood that the rectangular configuration of the closure flaps greatly facilitates use of box 10 as a shipping container.

It will thus be seen that the present invention provides a box, and corresponding blank, which can be used to good effect in a warehouse or storage operation, and can also be used as desired for shipping purposes. Thus, a given box can be initially used for warehousing purposes with the closure flaps thereof mechanically interlocked, and without damage to the box itself. When the box is emptied at the warehouse, it need not be returned to be refilled at a manufacturing site, but can simply be used as a shipping container directly from the warehouse.

Having thus described the invention, what is claimed as new and desired to be secured by Letters Patent is:

1. A box having interlockable closure flaps and comprising:

a bottom wall having four sides;

first, second, third, and fourth sidewalls respectively secured to the side edges of said bottom wall, extending upwardly therefrom, and being interconnected to one another; and first, second, third and fourth closure flaps respectively secured to the upper margins of corresponding sidewalls and each presenting an outermost side edge remote from the corresponding sidewall, and spaced end edges extending transversely of the outermost side edge, said second flap having a first line of weakness thereon adjacent one end thereof and extending from the outermost side edge of the second flap towards said second sidewall, the portion of said second flap between said first line of weakness and the proximal end edge being pivotal about an axis coincident with said first line of weakness, said third flap being adjacent said second flap and having second and third lines of weakness thereof adjacent the end of the third flap closest to the second flap, said second and third lines of weakness each extending from respective points on the outermost side edge of the third flap towards the third sidewall, the segment of said third flap between said second line of weakness and the proximal end edge of the third flap being pivotal about a second axis coincident with the second line of weakness, the part of said third flap between said second and third lines of weakness being pivotal about a third axis coincident with the third line of weakness.

2. The box as set forth in claim 1 wherein said closure flaps are each of generally rectangular configuration with the outermost side edge thereof substantially straight and parallel with the corresponding sidewall upper margins.

3. The box as set forth in claim 2 wherein said first line of weakness extends angularly from the outermost side edge of the second flap to approximately the point of intersection between the end edge of said one end, and the upper margin of said second sidewall whereby said second flap portion is substantialy triangular in configuration.

4. The box as set forth in claim 2 wherein said second line of weakness is substantially parallel with the end edges of said third flap, there being a cut line along the length of said third sidewall upper margin adjacent said third flap segment.

5. The box as set forth in claim 2 wherein said third line of weakness extends angularly towards said end of the third flap closest the second flap and substantially intersects the point of intersection of said second line of weakness and third sidewall whereby said third flap part is substantially triangular in configuration.

6. A box blank, comprising:

a unitary sheet of material cut and configured to present first, second, third and fourth sidewall-defining panels connected in order along mutually parallel fold lines and cooperatively presenting substantially continuous and parallel top and bottom margins;

bottom-defining closure flaps connected along the length of said bottom margin; and first, second, third and fourth top closure flaps of rectangular configuration respectively secured along the length of said top margin to corresponding panels, each of said top closure flaps presenting an outermost side edge remote from and substantially parallel with the top margin of the corresponding panel, and spaced end edges transversely disposed relative to the top margin, one of said flaps having a first line of weakness thereon adjacent one end thereof and extending from the outermost side edge of the one flap towards the corresponding panel to which the one flap is connected, the portion of said one flap between said first line of weakness and the proximal end edge of the one flap being pivotal about an axis coincident with said first line of weakness, another flap adjacent said one flap having second and third lines of weakness thereon adjacent the end of the other flap closest to the one flap, said second and third lines of weakness each extending from respective points on the outermost side edge of the other flap towards the corresponding panel to which the other flap is connected, the segment of said other flap between said second line of weakness and the proximal end edge of the other flap being pivotal about a second axis coincident with the second line of weakness, the part of said other flap between said second and third lines of weakness being pivotal about a third axis coincident with the third line of weakness.

7. The box blank as set forth in claim 6 wherein said first line of weakness extends angularly from the outermost side edge of the one flap to approximately the point of intersection between the end edge of said one end, and the upper margin of the corresponding panel to which the one flap is connected, whereby said flap portion is substantially triangular in configuration.

8. The box blank as set forth in claim 6 wherein said second line of weakness is substantially parallel with the end edges of said other flap, there being a cut line between said flap segment and the corresponding panel to which the other flap is connected, whereby the flap segment can pivot free of the last-mentioned panel.

9. The box blank as set forth in claim 6 wherein said third line of weakness extends angularly towards said end of the other flap closest the one flap and substantially intersects the point of intersection of said second line of weakness and the corresponding panel to which the other flap is connected whereby said flap part is substantially triangular in configuration.

* * * * *